US006209731B1

(12) United States Patent
Spamer et al.

(10) Patent No.: US 6,209,731 B1
(45) Date of Patent: Apr. 3, 2001

(54) GRAVITY FEED BOTTLE DISPENSING TRACK DEVICE HAVING FRONT STOPPER

(75) Inventors: William S. Spamer, Roswell; J. Marshall Suttles, Elberton; Dennis E. Parham; James Douglas Whiten, both of Kennesaw, all of GA (US)

(73) Assignee: Display Industries, LLC, Smyrna, GA (US)

( * ) Notice: Subject to any disclaimer, the term of this patent is extended or adjusted under 35 U.S.C. 154(b) by 0 days.

(21) Appl. No.: 09/207,708

(22) Filed: Dec. 9, 1998

Related U.S. Application Data

(63) Continuation of application No. 08/936,081, filed on Sep. 23, 1997, now Pat. No. 5,875,919, which is a continuation of application No. 08/728,729, filed on Oct. 11, 1996, now Pat. No. 5,706,978, which is a continuation of application No. 08/389,379, filed on Feb. 16, 1995, now Pat. No. 5,586,687.

(51) Int. Cl.[7] ..... A47F 7/00
(52) U.S. Cl. ..... 211/59.2
(58) Field of Search ..... 221/289, 130, 221/131, 298, 310, 307; 211/59.2, 74

(56) References Cited

U.S. PATENT DOCUMENTS

| | | | |
|---|---|---|---|
| 1,178,326 | 4/1916 | Lichtenberg | 193/14 |
| 2,279,093 | 4/1942 | Peters | 221/150 R |
| 2,311,449 | 2/1943 | Lilly | 221/150 R |
| 2,327,379 | 8/1943 | Thomas | 211/74 |
| 2,332,214 | 10/1943 | Forsthoefel et al. | 221/150 R |
| 2,440,902 | 5/1948 | Lutey | 294/87.28 |
| 2,620,691 | 12/1952 | Gould | 81/3.08 |
| 3,243,220 | 3/1966 | Karas | 294/87.28 |
| 3,454,168 | 7/1969 | Cahn | 211/74 X |
| 3,553,927 | 1/1971 | Anglade, Jr. | 53/448 |
| 3,606,024 | 9/1971 | Mierville | 211/193 |
| 3,900,112 | 8/1975 | Azzi et al. | 211/59.2 |
| 4,022,363 * | 5/1977 | Eliassen | 224/45 AA |
| 4,072,246 | 2/1978 | Paulin | 221/307 |
| 4,228,905 | 10/1980 | Cammarota | 211/71 |
| 4,310,097 * | 1/1982 | Merl | 211/490 |
| 4,318,485 | 3/1982 | Clement | 211/59.2 |
| 4,367,818 | 1/1983 | Suttles | 211/59.2 |
| 4,383,614 | 5/1983 | Miller | 211/59.2 |
| 4,394,910 | 7/1983 | Miller | 211/59.2 |
| 4,401,221 | 8/1983 | Suttles | 211/59.2 |
| 4,405,052 | 9/1983 | Spiros | 211/59.2 X |
| 4,478,337 | 10/1984 | Flum | 211/59.2 |
| 4,763,796 | 8/1988 | Flum | 211/59.2 |
| 5,259,518 | 11/1993 | Sorenson et al. | 211/59.2 |
| 5,279,430 | 1/1994 | Benton | 211/59.2 X |
| 5,586,665 | 12/1996 | Brousseau | 211/59.2 |
| 5,706,957 * | 1/1998 | Hardy | 211/59.2 |

FOREIGN PATENT DOCUMENTS

| | | |
|---|---|---|
| 72 00294 | 8/1973 | (FR) . |
| 2 625 664 | 7/1989 | (FR) . |
| 2 647 328 | 11/1990 | (FR) . |
| WO 94/10885 | 5/1994 | (WO) . |

* cited by examiner

*Primary Examiner*—Alvin Chin-Shue
*Assistant Examiner*—Sarah Purol
(74) *Attorney, Agent, or Firm*—Tsugihiko Suzuki; John L. James

(57) ABSTRACT

A gravity feed merchandising device includes a plurality of longitudinally extending, downwardly inclined tracks. Each track includes a pair of parallel rails defining a space therebetween. The rails support a row of bottles such that the underside of each bottle neck flange engages the rails for movement relative to the rails. Each track is provided at its front end with a spring-urged stopper so that the cap of the leading bottle in that track is prevented from dislodgement through the front end of the track when the leading bottle is supported by the track, but can be removed from the track through the front end when pulled against the stopper.

8 Claims, 13 Drawing Sheets

GRAVITY FEED BOTTLE DISPENSING TRACK DEVICE HAVING FRONT STOPPER

This is a continuation of application Ser. No. 08/936,081, filed Sep. 23, 1997, now U.S. Pat. No. 5,875,919 which is a continuation of application Ser. No. 08/728,729, filed Oct. 11, 1996, now U.S. Pat. No. 5,706,978, which is a continuation of application Ser. No. 08/389,379, filed Feb. 16, 1995, now U.S. Pat. No. 5,586,687.

BACKGROUND OF THE INVENTION

This invention relates to merchandising devices for soft drink bottles, and particularly to a gravity feed bottle dispensing device in which soft drink bottles are suspended by their neck flanges and carried forward by gravity on an inclined track.

Gravity feed bottle dispensers of the suspension type have been used in the merchandising of soft drink bottles such as PET bottles having outwardly projecting annular neck flanges. These dispensers have an elongate track having a pair of parallel rails extending along the track. The necks of flanged bottles are received between the track rails so that the bottles are engaged at their neck flanges with the rails and thus suspended by their necks. The bottles are automatically arranged in a row along the track as they are received in the track. The track is normally inclined downwardly toward its front end and thus the suspended bottles are allowed to gravity feed one after another to the front end as the leading or foremost bottles in the row are removed successively from the track through the front end. A length of the track adjacent to the front end is upturned relative to the remainder of the track to stop each leading bottle at the front end and to thereby present it for removal from the track. Conventional gravity feed bottle dispensers of the type described above are disclosed, for example, in U.S. Pat. Nos. 4,318,485; 4,367,818; and 4,401,221 which are owned by the assignee of the present invention.

While such conventional dispensers have experienced considerable success, they are not without disadvantages. When stopped at the front end, the leading bottle on the track is subject to pressure of the other bottles behind it and is thereby pushed forward. This causes the leading bottle to be tilted with respect to the vertical while it is presented for removal by customers. This can detract from the appearance of the displayed bottles particularly when two or more tracks are arranged side by side and the respective leading bottles on adjacent tracks are tilted at different angles.

What is needed, therefore, is an improved gravity feed bottle dispensing device which maintains the leading bottles substantially vertical.

SUMMARY OF THE INVENTION

In meeting the foregoing needs, the present invention provides a merchandising device for neck-flanged bottles. The device includes an elongate track which defines a longitudinally extending pathway, a support assembly for the track, and a stopper provided at the front end of the track. The track supports a row of flanged bottles such that the bottles are suspended by their neck flanges for movement along the pathway and are removable from the pathway through the front end of the track. The support assembly supports the track in a tilted condition such that the track is inclined downwardly toward its front end whereby the suspended bottles are allowed to gravity feed toward the front end when the leading bottle in the row is removed from the track. The stopper engages with the leading bottle to prevent its accidental removal through the front end. To improve the above basic arrangements, the device of the invention comprises a gate mechanism for blocking the pathway at a position between the front and rear ends of the track. The mechanism is activated to block the pathway when the leading bottle in the row engages the stopper so that forward movement of the other bottles behind the leading bottle is blocked. This allows the leading bottle to be free of pressure of the other bottles and to be disposed substantially vertical when stopped at the front end of the track.

The gate mechanism may be connected to the track to cooperate with the leading bottle so that it is activated to block the pathway in response to arrival of the leading bottle at the front end of the track and deactivated to unblock the pathway in response to removal of the leading bottle from the front end. Such a gate mechanism may include a seesaw arm having a forward end adjacent to the front end of the track and extending along the pathway to a backward end. The seesaw arm is pivotally connected at its intermediate position to the track for pivotal movement between an activated position and a deactivated position. When in the activated position, the arm allows its backward end to be in the pathway and the forward end to be out of the pathway whereas in the deactivated position, the arm causes the forward end to be in the pathway. As a result, when the leading bottle is brought to the front end, the forward end of the arm is thrust aside by the leading bottle so that the arm is pivoted to the activated position.

According to a preferred embodiment of the invention, the merchandising device further comprises converting means for turning the gate mechanism inoperable so that the gate mechanism can be deactivated even when the leading bottle is at the front end of the track. This arrangement enables successive front loading of the bottles. One preferred form of such converting means is an arrangement wherein the pivot of the seesaw arm is connected to the track for substantially linear reciprocal movement between an operable position and an inoperable position. In the operable position, the pivot allows the arm to move between the activated and deactivated positions whereas in the inoperable position, the pivot allows both the forward and backward ends of the arm to be outside the pathway at the same time.

Another preferred form of the converting means is an arrangement wherein the seesaw arm has two portions, i.e., a front element which provides the forward end and a rear element which provides the backward end. The front element is pivotally connected to the track so that the arm is pivotable between the activated and deactivated positions. The rear element is connected to the front element for locking the rear element against forward pivotal movement beyond a limit relative to the front element while permitting backward pivotal movement relative to the front element. Such backward movement brings the rear element to the position out of the pathway even when the forward end of the arm is disposed out of the pathway.

The present invention also provides a gravity feed bottle dispensing device wherein the length of the track is adjustable either to a longer size or to a shorter size. The device in this aspect of the invention has a track comprising a front elongate member, a rear elongate extension member and a connector for separably interconnecting the front and rear members in an end-to-end relationship. The connector has a cross-sectional configuration adaptable for telescopingly receiving both the backward end portion of the front member and the forward end portion of the rear member so as to allow the front and rear members to define a single continuous pathway of the bottles.

The invention further provides a bottle dispensing device which can eliminate the situation in which the support rails of the track are mistakenly received between a bottle cap and the adjacent neck flange. Such a mistake can be made during the bottle loading process particularly when there is a substantial gap between the cap and the flange of each bottle. Such a mistake would result in damage to the bottle cap, which in turn would cause the bottle to fall off of the track. The merchandising device in this aspect of the invention comprises a track having a pair of parallel longitudinally extending rails for hanging bottles by their neck flanges, and a rail-thickening means fixedly disposed on each rail at adjacent to at least one of the front and rear ends of the track. The thickening means increases the vertical size of at least a part of each rail whereby the above discussed mistake or problem can be eliminated. The thickening means may be secured to either the upper surfaces or the lower surfaces of the rails, or it may be formed integrally with the rails.

The present invention further provides a merchandising device which facilitates adjustment of the inclination of the track. The device according to this aspect of the invention has a track and a support assembly. The assembly comprises a pair of front and rear transverse support members disposed perpendicularly to the track, and a support rack placed on a horizontal support surface to support each of the front and rear transverse members at a desired height from the support surface. The track comprises interconnecting means for movably connecting one of the front and rear transverse members to the track for movement at least partially along the length of the track. This enable the inclination of the track to be adjusted to a desired angle without any adjustment to the support rack.

The preferred embodiment of the interconnecting means is a pair of slots formed respectively in the side walls of the track which is formed in a channel shape. The slots extend partially along the track and arranged to receive associated one of the front and rear transverse members so that the associated transverse member is slidably movable along the slots.

The present invention further provides a modular merchandising device which provides flexibility in arrangement of a plurality of tracks. The modular device comprises a plurality of parallel elongate tracks and a support assembly for the tracks. The support assembly comprises a pair of front and rear transverse support members disposed perpendicularly to the tracks. Each track comprises first means for removably mounting the track on the front transverse member, and second means for removably mounting the track on the rear transverse member. Each mounting means comprises means for movably connecting the respective track to the respective transverse member for movement along the respective transverse member. Each transverse member comprises means for locking each track thereon. The device of the invention in this aspect allows variation in number and position of the tracks on the transverse members and thereby adds more flexibility in the way the tracks are arranged on the support means.

One preferred embodiment of the locking means comprises spacer means removably mounted on each transverse member to maintain a space between adjacent tracks.

One preferred embodiment of the movably connecting means comprises a pair of engaging apertures formed respectively in the side walls of the respective track to slidably receive the respective transverse member.

According to a preferred embodiment of the invention in this aspect, the support means further comprises a support rack and third mounting means. The support rack is placed on a horizontal support surface to support each transverse member at the position above the support surface. The third mounting means removably mounts each transverse member on the support rack at any one of vertically arranged positions on the rack so that each transverse member is retained at a desired height from the support surface. This arrangement allows easy change of the vertical position of the tracks.

The objects and advantages of the present invention will be apparent from the following description, the accompanying drawings and the appended claims.

DETAILED DESCRIPTION OF THE PREFERRED EMBODIMENTS

FIGS. 1 to 6 illustrate a merchandising device according to this invention. This device includes one or more bottle dispenser units of the kind shown in FIG. 1 removably mounted on a rack. The rack can be a conventional four-post rack or alternatively a rack consisting of a base having a vertically extending back wall on which the unit-supporting arms are cantilevered. Each device may have only one dispenser unit; however, it will in general have two or more dispenser units arranged one above another.

Figure 1:
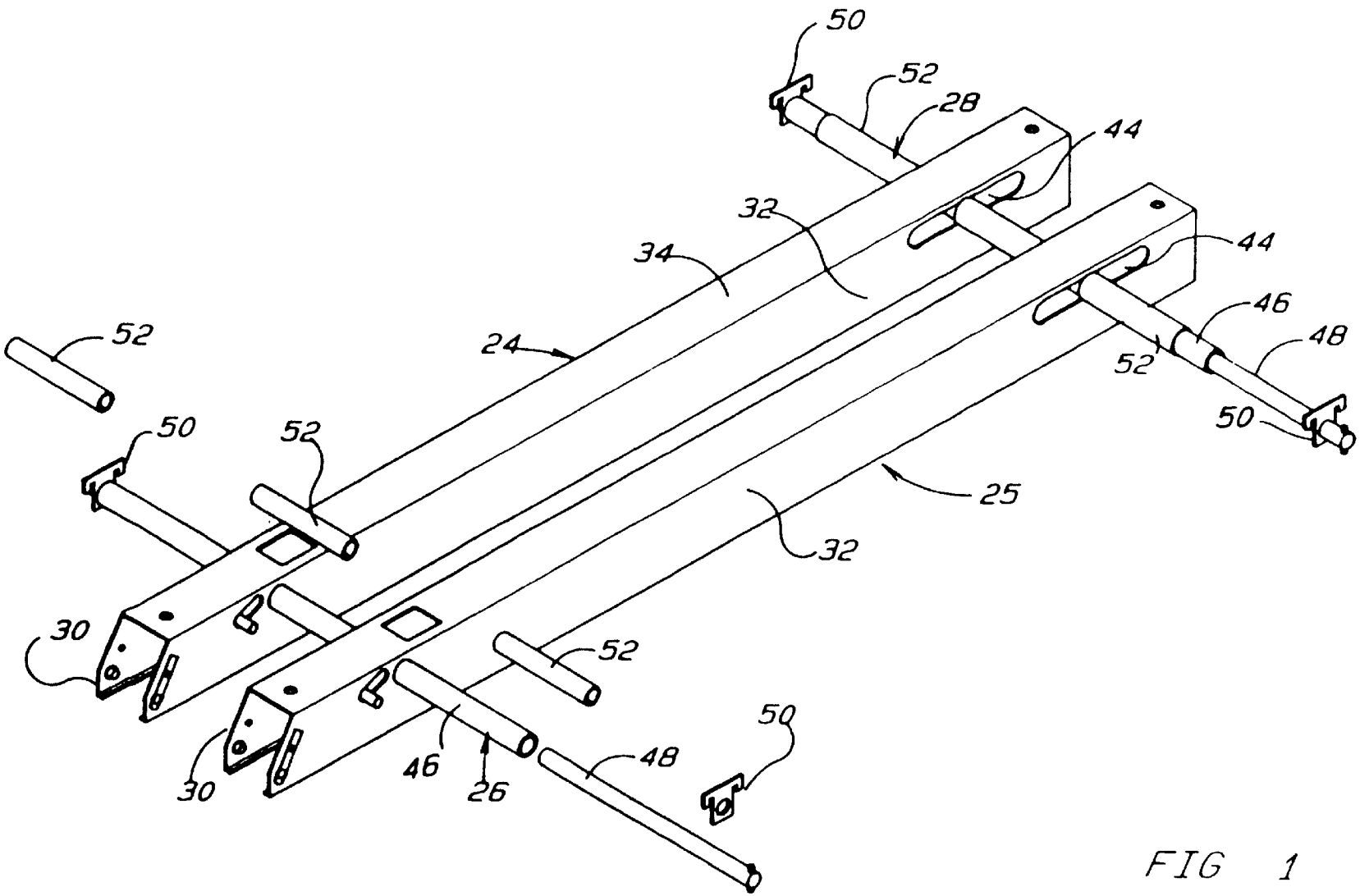
FIG. 1 is a perspective view of a dispenser unit of a merchandising device according to the present invention.
Figure 2:
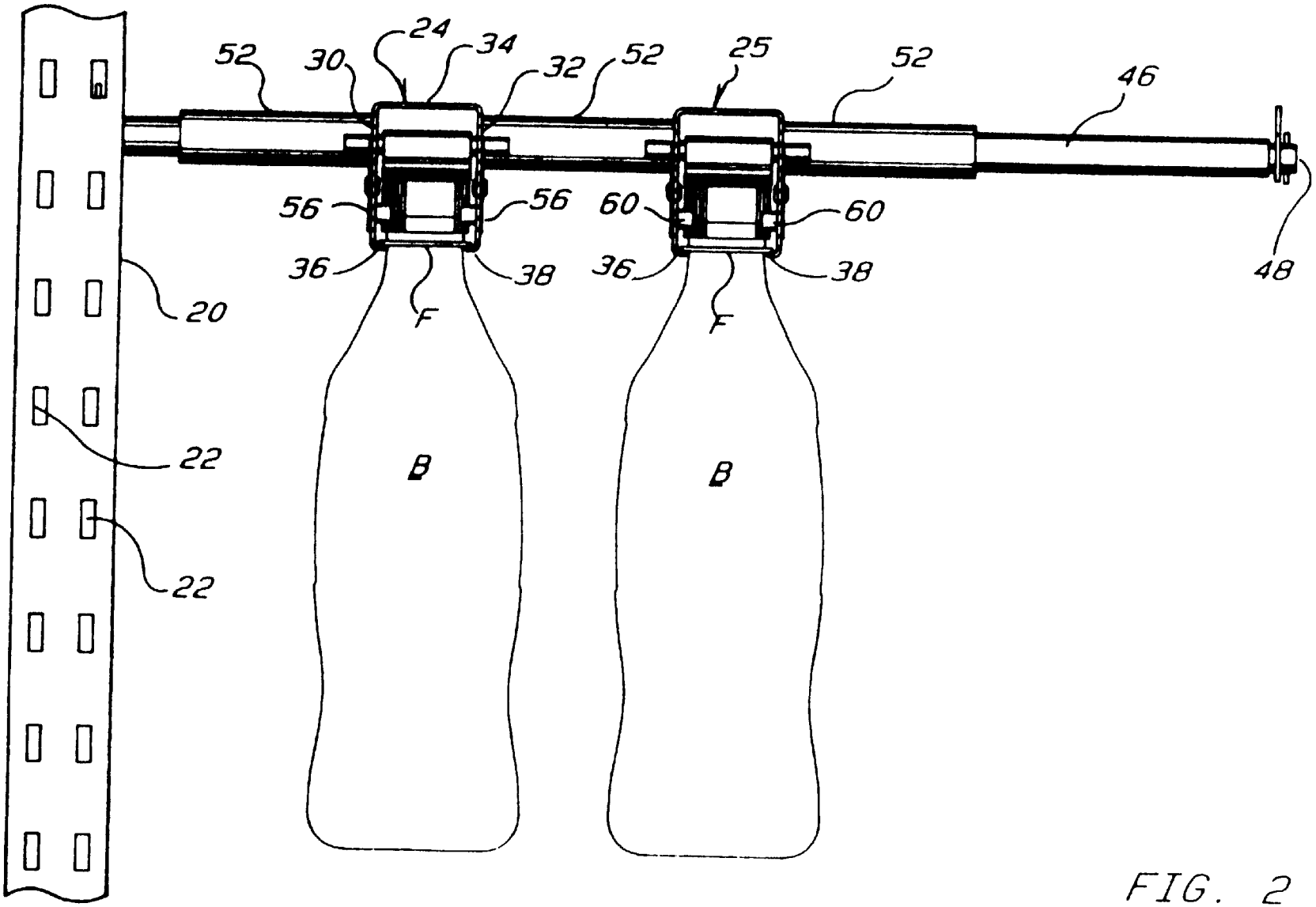
FIG. 2 is a front view of the dispenser unit in FIG. 1, showing bottles held at their neck flanges by the tracks and hanging from the respective front ends of the tracks.

The dispenser unit in FIG. 1 is designed for use preferably on a four-post rack (only partially shown in FIG. 2) having four upright corner posts, i.e., a pair of front posts and a pair of rear posts, connected together by horizontal members of a suitable number. The four corner posts are of a substantially identical structure having a number of engaging openings arranged vertically along the side wall of the respective corner post. An example of such a corner post is shown in FIG. 2 at reference numeral 20. The post 20 is one of the front corner posts and is shown as having two vertical rows of openings 22. However, one vertical row of openings in each corner post may be sufficient in most of the cases wherein the post is used as a vertical support for the dispenser units.

The dispenser unit in FIG. 1 has a plurality of substantially parallel elongate tracks 24 and 25 interconnected through a pair of front and rear transverse support members 26 and 28. The tracks 24 and 25 are virtually identical to each other, and so are the front and rear transverse members 26 and 28. Accordingly, the details will hereinafter be described regarding only the track 24 and the transverse member 26. Those portions of the track 25 identical to the track 24 are identified by the same reference numerals and those of the member 28 identical to the member 26 are denoted by the same reference numerals.

Figure 3:
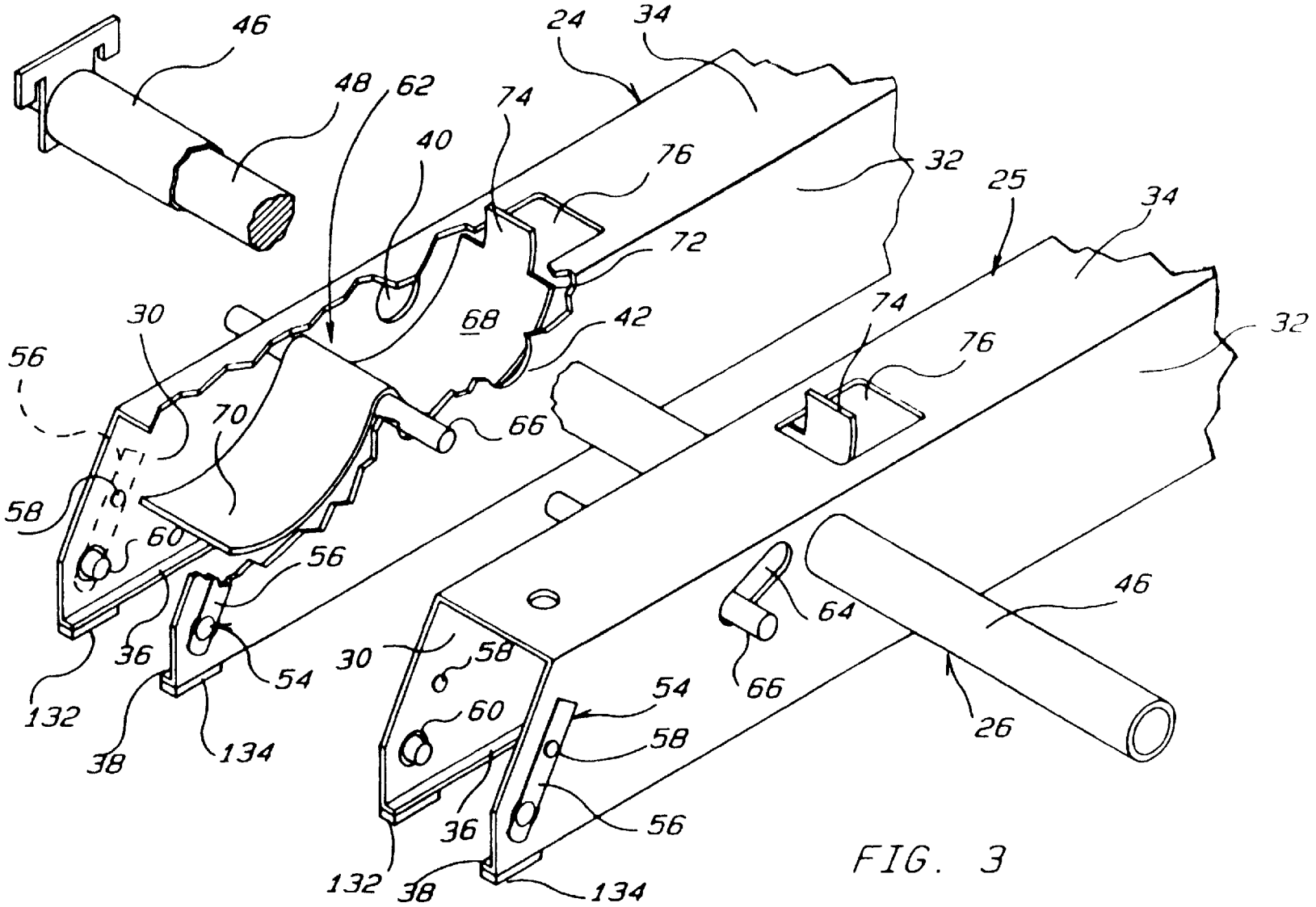
FIG. 3 is an enlarged fragmentary perspective view, partially cutaway, of the tracks in FIG. 1.

The track 24 is formed preferably of a metal plate or a molded plastic and has a pair of longitudinally extending opposed side walls 30 and 32 joined together along their upper edges by a top wall 34. The side walls 30 and 32 and the top wall 34 in cooperation form a channel structure having an inverted U-shaped cross section. A pair of parallel rails 36 and 38 as best shown in FIGS. 2 and 3 are joined respectively along the lower edges of the side walls 30 and 32 so as to project inwardly of the track 24 toward each other. A space is maintained between the rails 36 and 38 to receive therein the necks of flanged bottles. The distance between the rails 36 and 38 are such that when bottle necks are received between the rails 36 and 38, the bottles are automatically arranged in a row and the undersides of the neck flanges engage the rails 36 and 38 to allow the bottles to be suspended for sliding movement along the track 24.

Typical flanged bottles used with the device of the invention may be soft drink bottles formed of plastic such as PET and having an integrally formed outwardly projecting annular flanges at their necks immediately under their caps. The manner in which flanged bottles are suspended by their neck flanges is best shown in FIG. 2 wherein the bottles are designated at "B" and the bottle neck flanges are designated at "F". The bottles suspended and arranged in a row are gravity fed one after another to the front end of the track 24 as the leading bottles in the row successively are removed from the track 24 through the front end, which will be described in more details later.

According to a feature of the invention, the side walls 30 and 32 of the track 24 are provided at near the track front end with a pair of opposed circular apertures 40 and 42 (shown in FIG. 3) and at near the track rear end with a pair of opposed slots 44 (only one shown in FIG. 1). Each slot 44 extends partially along the length of the track 24. The apertures 40 and 42 are identical in diameter and receive the front transverse member 26 so that the front portion of the track 24 is supported by the member 26. The diameter of the apertures 40 and 42 is such that it allows the track 24 to slide along the member 26. The slots 44 are of the same size and shape and receive the rear transverse member 28 so that the rear portion of the track 24 is supported by the member 28. The width of the slots 44 is such that it allows the track 24 to slide along the member 28 as well as the rear member 28 to slide along the length of the slots 44.

The front transverse member 26 is formed preferably of metal. It extends between the front corner posts such as at 20 and is supported at its opposite ends by the front corner posts. The transverse member 26 includes an outer round tube 46 having an outer diameter slightly less than the apertures 40 and 42 and a pair of inner round rods 48 (only one shown in FIGS. 1, 2 and 3) respectively received telescopingly or slidably in the opposite end portions of the outer tube 46. This telescopic structure provides flexibility in length of the transverse member 26 so that the member 26 can be used on racks having different front post distances. The opposite ends of the member 26 are provided by the respective free ends of the inner rods 48 and removably mounted on the front corner posts by means of suitable brackets respectively. Each bracket has a first portion for engagement with the associated end of the transverse member 26 and a second portion for insertion into one of the openings of the associated front corner post. A typical example of such a bracket includes a T-hook, S-hook and the like. FIG. 1 shows a T-hook 50 loosely engaged with each end of the transverse member 26 so as to be a built-in part of the dispenser unit.

The rear transverse member 28 extends between the rear corner posts of the rack and is removably mounted at its opposite ends on the rear corner posts. The outer diameter of the outer tube 46 of the member 28 is slightly less than the width of the slots 44. The remainder of the rear member 28 is identical to the front member 26.

According to another feature of the invention, spacer sleeves 52 are disposed on the transverse members 26 and 28 as best shown in FIGS. 1 and 2. They are located on the opposite sides of each track. These sleeves 52 are formed of flexible material such as plastic and have a substantially C-shaped cross section such that they snap fit around the transverse members 26 and 28. The sleeves 52 when fit on the members 26 and 28 have an outer diameter substantially greater than the diameter of the apertures 40 and 42 and than the width of the slots 44. The sleeves 52 therefore function as spacers for maintaining a proper space between the tracks 24 and 25 as well as means for locking the tracks 24 and 25 at proper positions on the transverse members 26 and 26.

It should however be recognized that by using the sleeves of different lengths, the positions of the tracks 24 and 25 can be changed along the length of the transverse members and the space between the adjacent tracks can be adjusted to a desired size. It will also be readily understood that the number of the tracks on the transverse members 26 and 28 can be adjusted easily. To reduce the number of the tracks, some of the sleeves 52 are disengaged from the transverse members 26 and 28 and then the tracks of a desired number are removed from the members 26 and 28. To increase the number, on the other hand, one or more additional tracks similar to the above tracks are connected to the transverse members and then additional sleeves 52 are fit on the transverse members.

According to a further feature of the invention, the track 24 is provided with a stopper means 54 at its front end. The stopper means 54 is best shown in FIG. 3 wherein it includes a pair of leaf springs 56. Each leaf spring 56 is secured at near its upper end to the outside surface of the respective track side wall by a rivet 58, and is provided at near its lower end with a protrusion 60. The protrusion 60 passes through a small aperture formed in the respective side wall and projects inwardly from the inside surface of that side wall.

These protrusions 60 of the stopper means are normally disposed in the bottle pathway which is defined inside the track 24, as best shown in FIG. 2. When the leading bottle in the track arrives at the front end of the track 24, it abuts the protrusions 60 and is thereby prevented from accidental dislodgement through the front end. However, when such a leading bottle is pulled forward by for example a customer, the protrusions 60 are pushed or retracted into the small apertures in the respective side walls 30 and 32 and allow removal of the leading bottle. The retracted protrusions 60 are urged by the springs 56 inwardly of the track 24 and thus after removal of the leading bottle, they are brought back to their normal positions to be ready for the next leading bottle.

In accordance with a further feature of the invention, a gate mechanism 62 as shown in FIG. 3 is provided at the location near the front end between the stopper means 54 and the rear end of the track 24. The mechanism 62 comprises a pair of slots 64 (only one shown in FIG. 3), a pivot 66 and a seesaw arm 68. The slots 64 are formed respectively in the side walls 30 and 32. The pivot 66 extends transversely across the track 24 and is received loosely at the opposite ends thereof in the slots 64 for movement along the slots 64. The arm 68 is disposed within and generally along the track 24 and is secured at an intermediate position thereof to the pivot 66. Each slot 64 is disposed obliquely along the respective side wall in such a manner that the rear end of the slot 64 is located at a position closer to the top wall 34 than its front end. This causes the pivot 66 to be biased by the gravity to the front end of each slot 64 so that the pivot 66 is normally located in the position as shown in FIGS. 3–5.

Figure 4:
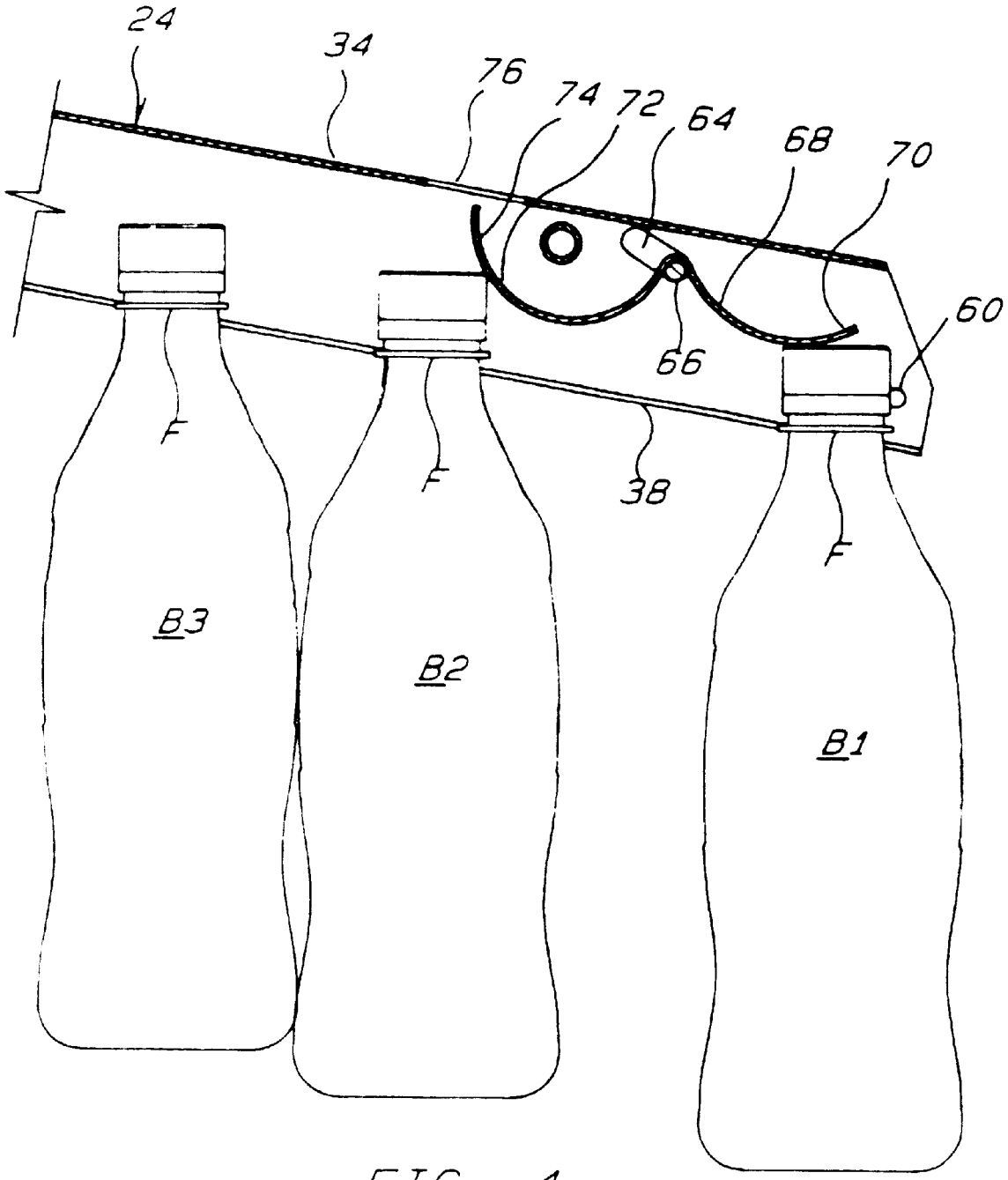
FIG. 4 is a fragmentary longitudinal sectional view of one of the tracks in FIG. 1, showing the gate mechanism held in the activated position by the leading bottle.
Figure 5:
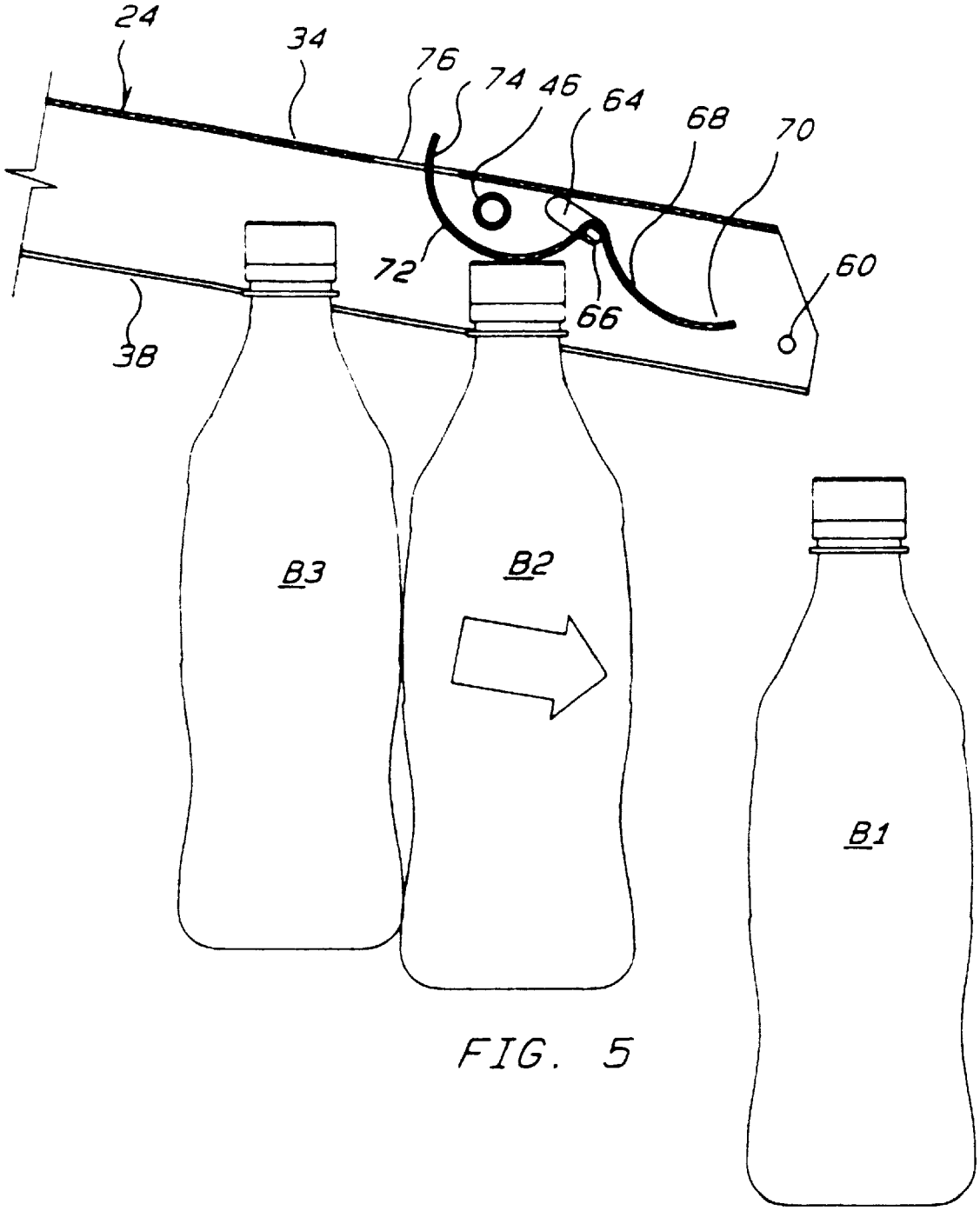
FIG. 5 is a view similar to FIG. 4, showing the second leading bottle which has released by the gate mechanism and sliding down on the track.
Figure 6:
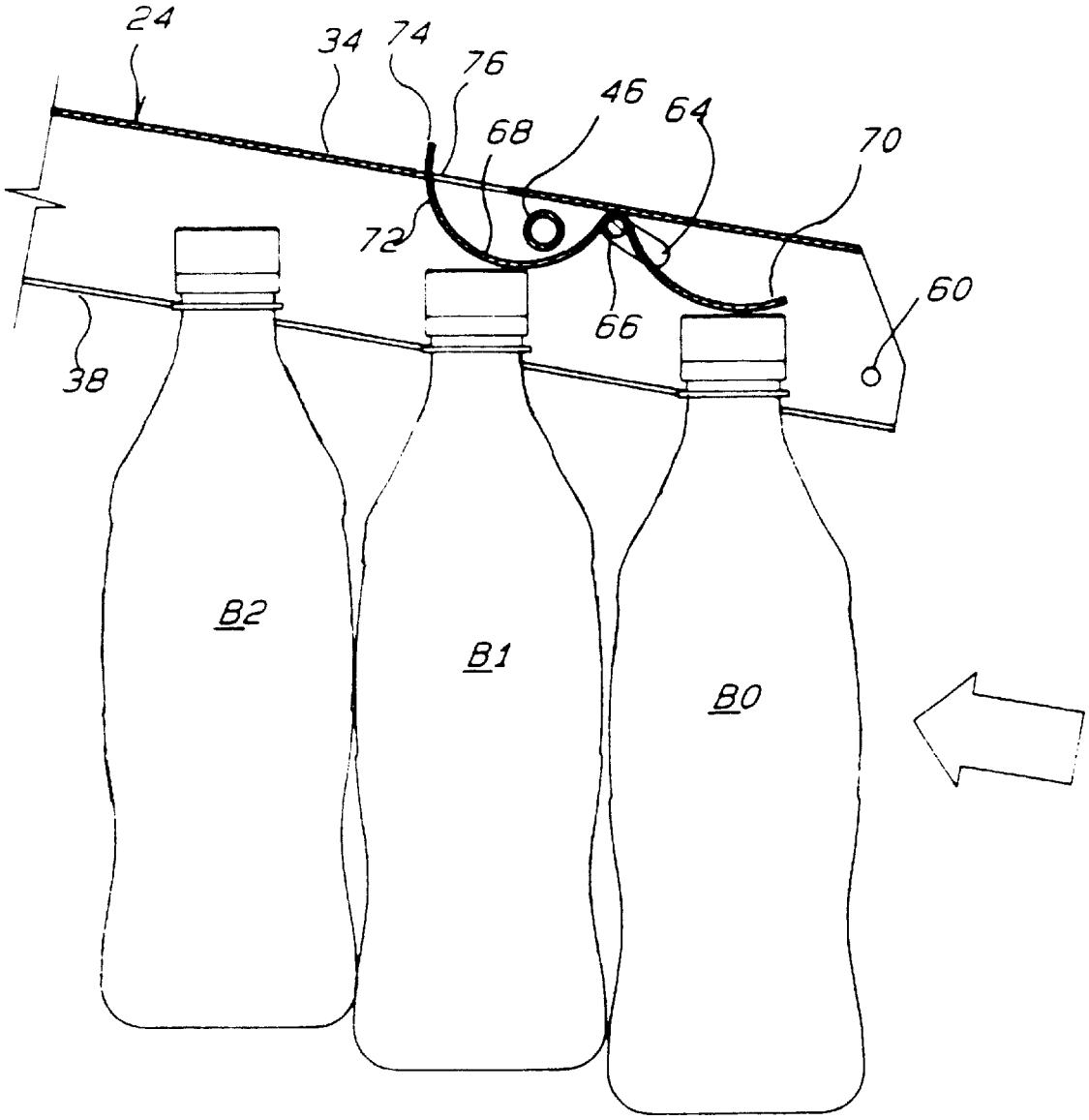
FIG. 6 is a view similar to FIG. 4, showing the gate mechanism brought to the inoperable position.

The seesaw arm 68 is formed preferably by bending a plate metal into a structure having a generally ω-shaped longitudinal-section of the kind shown in FIGS. 4–6. The portions of the arm 60 near the forward end 70 and the backward end 72 are upwardly curved to form downwardly convexly bowed lower surfaces. These bowed surfaces cause to be minimized the contact between the arm 68 and the bottles on the track 24, which in turn reduces the chance that the bottles are jammed under the arm 68.

The reference numeral 74 in FIG. 3 designates an extension portion formed at the backward end 72 of the arm 68. The extension portion 74 prevents the backward end 72 from being stuck on the bottles. An aperture 76 is formed in the top wall 34 and allows the extension portion 74 to project outwardly of the track 24 therethrough. This enables the arm 68 to be pivoted clockwise to the position as shown in FIG. 5 where the forward end 70 is positioned inside the bottle pathway and the backward end 72 is outside. This position will hereinafter be referred to as "deactivated position". On the other hand, the arm 68 is pivotable counterclockwise to the position shown in FIG. 4 where the forward end 70 is outside the pathway and the backward end 72 is inside. This position will hereinafter be referred to as "activated position".

To set up the above merchandising device, the one or more dispenser units are first assembled. The number of the dispenser units is selected depending on the vertical size of the rack and the height of the bottles to be displayed on the device. The tracks of an appropriate number are employed for each dispenser unit and secured on the respective pair of front and rear transverse members 26 and 28. The appropriate number may be varied depending on the width of the rack, i.e., the distance between the front corner posts, as well as the width of the bottles.

Subsequent to the assembly of the dispenser units, each unit is mounted on the rack by using the brackets 50. The openings 22 of the corner posts with which the brackets 50 are engaged are selected such that each of the front and rear transverse members 26 and 28 is held substantially horizontally while the rear transverse member 28 is supported at the position higher than the front transverse member 26. This arrangement permits the tracks 24 and 25 to be inclined downwardly toward their respective front ends.

The angle of inclination of the tracks from the horizontal may be about 1 to 20 degrees, preferably about 2 to 18 degrees and most preferably about 8 to 10 degrees. The angle of inclination can be changed easily due to the arrangement wherein the rear transverse member 28 is slidable along the slots 44. More specifically, such an arrangement enables change of the vertical position of either one of the members 26 and 28 without changing the distance between the front and rear corner posts. However, a preferred front and rear post distance is generally equal to the distance between the aperture 40 and the front end of the associated slot 44.

The arrangement with the slidable rear member 28 also facilitates the mounting of each dispenser unit onto the rack. More specifically, it enables the transverse members 26 and 28 to be mounted on the corner posts one by one rather than forcing them to be mounted at the same time.

The merchandising device thus assembled can be either front-loaded or back-loaded. When loaded through the rear end of the track 24, bottles slide down on the track 24 toward the front end. The leading bottle in the track 24 first reaches the front end of the track 24, is captured by the stopper means 54 and pushes the forward end 70 of the arm 68 up so that the arm 68 takes the activated position as shown in FIG. 4. As in the activated position, the arm 68 by its backward end 72 blocks the pathway at behind the leading bottle B1. This causes the second leading bottle B2 to be captured by the arm 68 as shown in FIG. 4, which in turn separates the leading bottle Bi apart from all the following bottles such as B2 and B3. As a result, the leading bottle B1 is kept free of pressure of the bottles behind it and thus is disposed substantially vertical.

FIG. 5 shows the process in which the next leading bottle B2 replaces the leading bottle B1. When the bottle B1 is removed from the front end of the track 24, the forward end 70 of the arm 68 is allowed to pivot down to the deactivated position as shown in FIG. 5. This releases the next leading bottle B2 from the backward end 72 and allows it to slide down, as indicated by the arrow, to the front end of the track. At the front end, the bottle B2 pushes the arm 64 back to the activated position so that forward movement of the third leading bottle B3 is blocked.

Bottles may be loaded into the track through the front end according to the device of the invention. Such a front-loading can be enabled by the aforementioned arrangement wherein the pivot 66 is slidable along the slot 64. When new bottles are front loaded, the pivot 66 is moved up along the slot 64 to bring the seesaw arm 68 to an inoperable position as shown in FIG. 6. Such movement is caused due to the condition such as shown in FIG. 4 wherein pivotal movement of the arm 68 is restricted by the old bottles B1 and B2. More particularly, pushing the bottle B1 backward from the position as shown in FIG. 4 results in upward sliding movement of the arm 68 rather than its pivotal movement. This in turn defines a space under the arm 68 as shown in FIG. 6 large enough to allow the bottle B1 to move backward along the track 24 so that the new bottles such as at BO can subsequently be front loaded successively.

Figure 7:
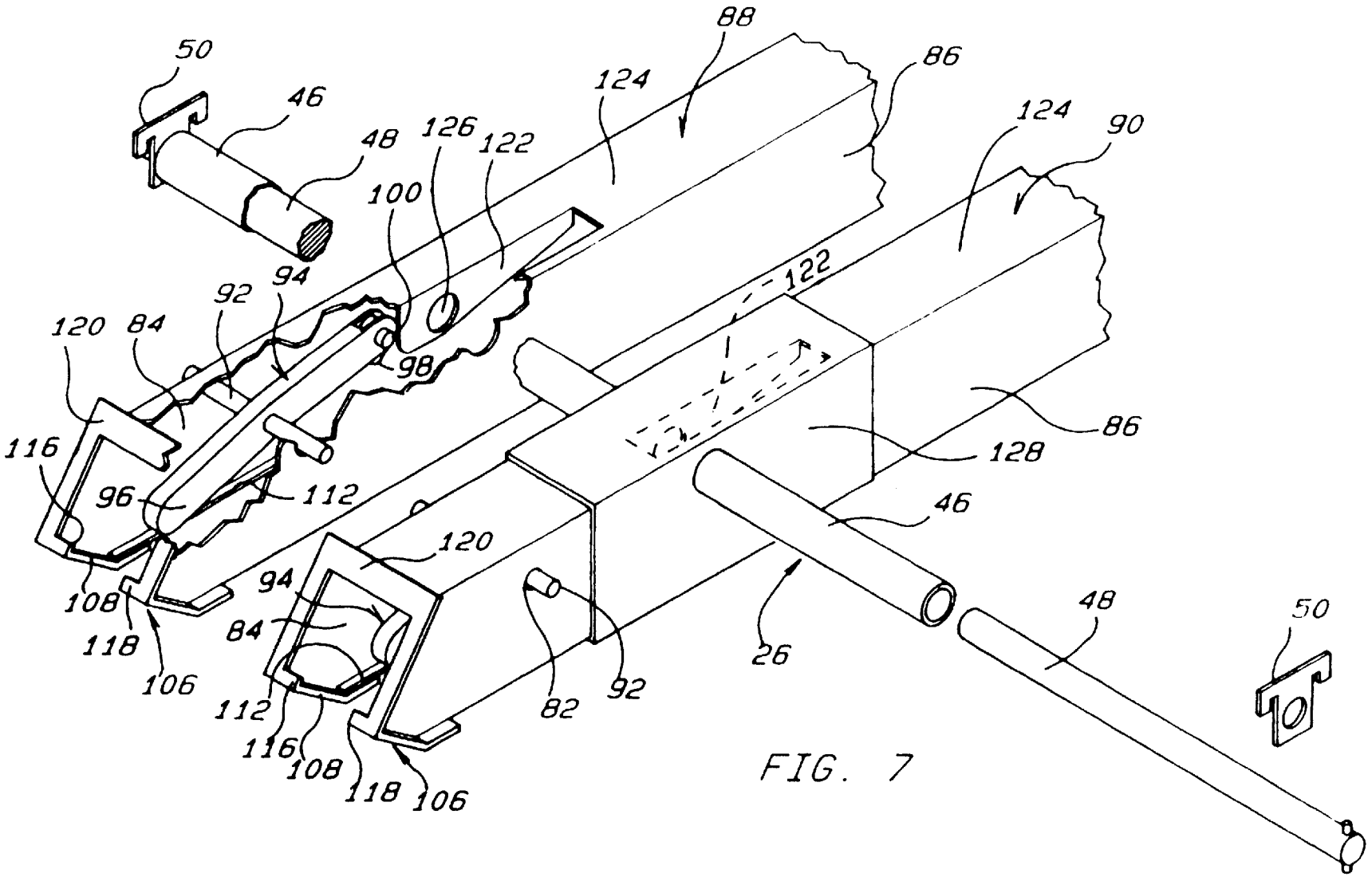
FIG. 7 is an enlarged fragmentary perspective view, partially cutaway, of the tracks of a modified merchandising device according to the invention.
Figure 8:
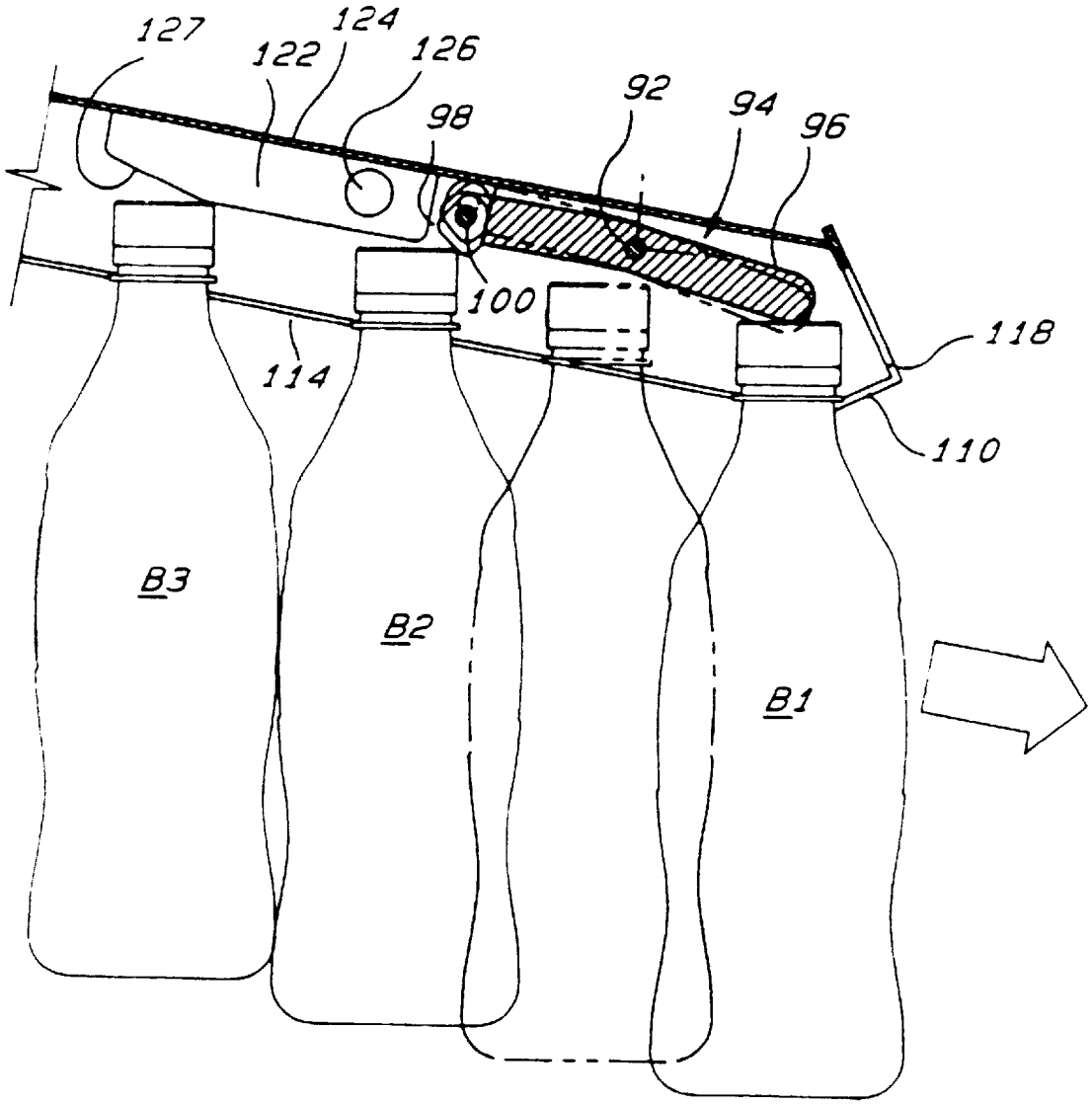
FIG. 8 is a fragmentary longitudinal sectional view of one of the tracks in FIG. 7, showing the activated position of the gate mechanism in the solid line and the deactivated position in the phantom line.
Figure 9:
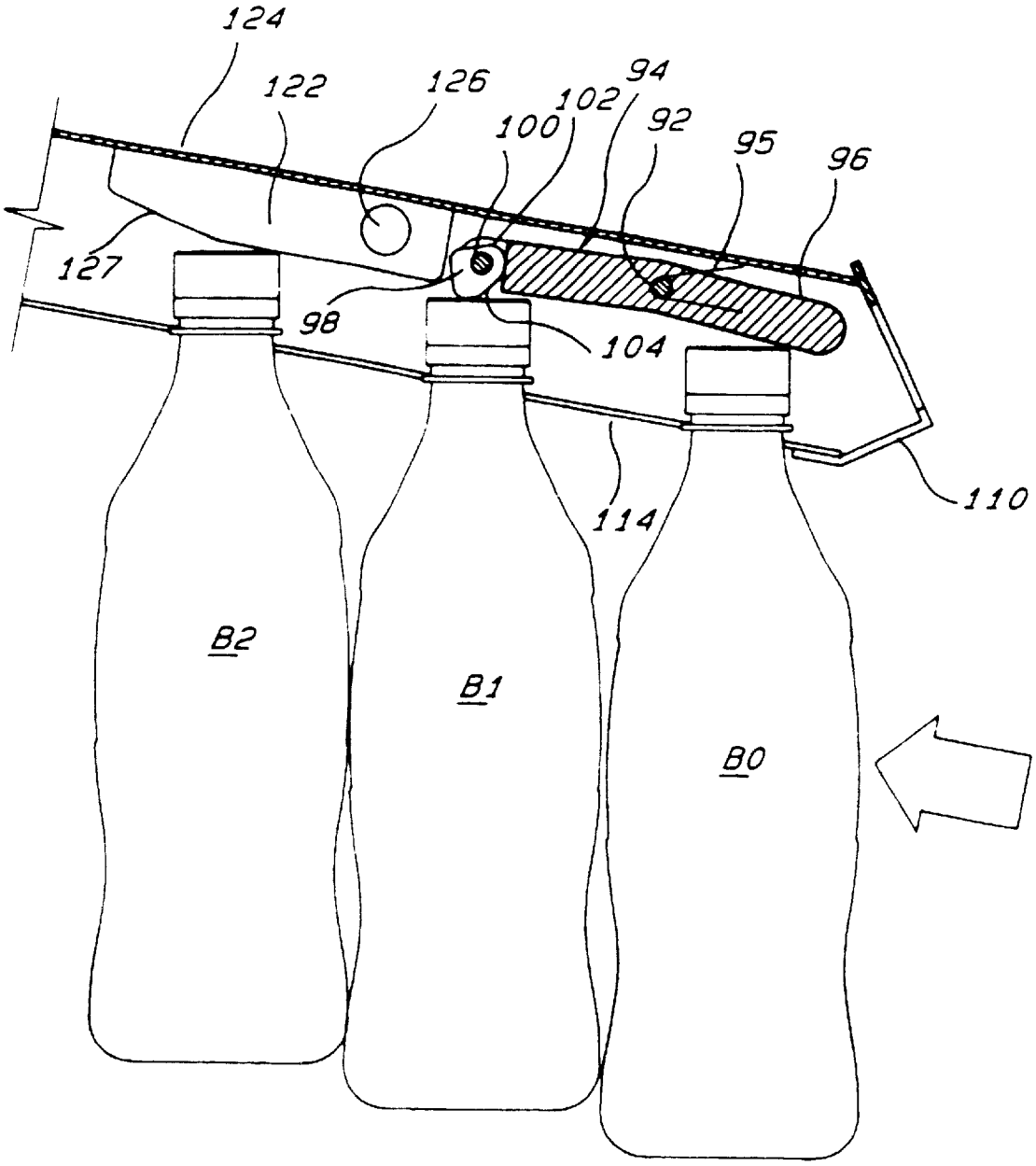
FIG. 9 is a view similar to FIG. 8, showing the latch in the inoperable position.

FIGS. 7–9 illustrates a modified form of the merchandising device according to the invention wherein a different gate mechanism is used. Such a gate mechanism is best shown in FIG. 7 and it comprises a pair of apertures 82 (only one shown in FIG. 7), a pivot 92, and a seesaw arm 94. The apertures 82 are formed respectively in the side walls 84 and 86 of each track such as at 88 and 90. The pivot 92 extends transversely across each track and is received rotatably at the opposite ends thereof in the apertures 82. The seesaw arm 94 is disposed within and generally along each track. Because the tracks 88 and 90 are of virtually the same structure, only the track 88 will hereinafter be described.

The arm 94 includes a front lever 96 secured at an intermediate position thereof to the pivot 92 and a rear latch 98 pivotally connected to the rear end of the lever 96 by an auxiliary pivot 100. The arm 94 is pivotable about the pivot 92 between the activated position as shown by the solid line in FIG. 8 and the deactivated positions as shown by the phantom line in FIG. 8. The latch 98 is connected to the lever 96 such that it is locked against its forward pivotal movement beyond the position shown in FIG. 8 while permitting its backward pivotal movement to and even beyond the position shown in FIG. 9. The position of the latch 98 as in FIG. 8 will hereinafter be referred to as "operable position" whereas the position of the latch as in FIG. 9 will hereinafter be referred to as "inoperable position". The arm 94 is urged by a suitable means such as a spring 95 (shown in FIG. 9) to the deactivated position whereas the latch 98 is normally retained in the operable position due to the gravity. It should however be readily understood that the arm 96 may be urged to the deactivated position by the gravity.

The lever 96 and the latch 98 are formed preferably of metal. As best shown in FIG. 9, the lever 96 has the shape of a slightly downwardly curved or bent bar rather than a straight bar, which includes a bifurcated rear end in which the latch 98 is pivotally received. The latch 98 has a rounded front surface 102 for permitting its pivotal movement relative to the lever 96 and a flat lower front surface 104 for abutting the rear end face of the lever 96. The flat surface 104 restrict forward pivotal movement of the latch 98 beyond the position as shown in FIG. 8. The lower surface of the latch 98 is also rounded to minimize the contact between the latch 98 and a bottle which moves immediately under the latch 98.

Each track of this modified form of the invention also employs a stopper means different from the stopper 54 in the preceding form of the invention. Such stopper means is designated at 106 and it comprises a length of the track 88 adjacent to the front end. Such a length is upturned relative to the immediately preceding length of the track 88 to provide forwardly upwardly sloping portions 108 and 110 of the rails 112 and 114. When the leading bottles in the track 88 travel along the sloping portions, they are braked to a stop and presented for removal from the track 88.

At the forward ends of the sloping portions 108 and 110, there are provided thickened portions 116 and 118, respectively. These thickened portions 116 and 118 have a greater thickness than the remainder of the rails 112 and 114 and prevent the rails 112 and 114 from being mistakenly received between the cap and the flange of a bottle during the bottle loading process. To achieve such an objective, it is preferred that the thickened portions 116 and 118 have a thickness greater than the gap between the cap and the flange of each bottle to be displayed on the device. The thickened portions 116 and 118 also provide the opposite ends of a C-shaped reinforcing flange 120 which is designed to increase the rigidity of the front end of the track 88. Such an reinforcing flange 120 can also be used to provide a billboard surface. The upturned length of the track 88 may be formed integrally with the track 88 or it may be provided as a separate replaceable portion.

Reference numeral 122 designates a ceiling member which is struck from the top wall 124 of the track 88 and folded ninety degrees down into the track 88. The ceiling member 122 provides a guide for bottles and functions particularly to prevent the second leading bottles from being tilted excessively. The function of the ceiling member 122 will be described in more details later. The ceiling member 122 is provided with an aperture 126 for receiving the transverse member 26 and a guide surface 127 sloping forwardly and downwardly. Reference numeral 128 is a channel member mounted on the track 88 to reinforce the area of the track 88 where the latch 98 is located. The remainder of the merchandising device is virtually identical to the device of the first form of the invention and thus those portions of the device identical to the device in FIG. 1 are identified by the same reference numerals.

When bottles are loaded through the rear end of the track 88, the leading bottle in the track 88 is first captured by the stopper means 106 and pushes the arm 94 up to pivot it to the activated position as depicted by the solid line in FIG. 8. The arm 94 in the activated position causes the second leading bottle B2 to be captured by the latch 98. The captured bottle B2 bears pressure of other bottles therebehind and thereby the leading bottle B1 is left alone at the front end of the track 88 to be displayed in a substantially vertical condition.

The second leading bottle B2 tends to be disposed at the position shown in FIG. 8 in a forwardly tilted condition as it bears pressure of other bottles. The cap of such a tilted bottle B2 abuts the ceiling member 122 and thereby the bottle B2 is restrained from excessive forward tilting. Excessive tilting would increase the chance that the bottles are jammed under the latch 98.

The second leading bottle B2, when tilted, tends to be wedged into the space between the latch 98 and the rails 112 and 114, which causes the side walls 84 and 86 to be forced outwardly. Such wedging force could increase the distance between the rails 112 and 114 and thereby subjects the bottles to the risk of accidental falling off of the tracks 88. The channel piece 128, however, rigidifies the portion of the track 88 that is subject to such force and prevents the track 88 from being wedged open.

When the bottle B1 is removed from the track 88, the arm 94 is brought to the deactivated position. This releases the next leading bottle B2 so that it slides down along the track 88 toward the front end thereof as illustrated by the phantom line in FIG. 8. At the front end, the bottle B2 pushes the arm 94 back to the activated position so that the third leading bottle B3 is captured by the latch 98.

This device can also be front-loaded owing to the latch 98. When new bottles are front loaded, the latch 98 is pivoted to the inoperable position as shown in FIG. 9. More particularly, pushing the bottle B1 backward against the latch 98 while the arm 94 is in the activated position causes backward pivotal movement of the latch 98. This in turn defines a space under the latch 98 as shown in FIG. 9 large enough to allow the bottles B1 and B0 to move backward therethrough.

Figure 10:
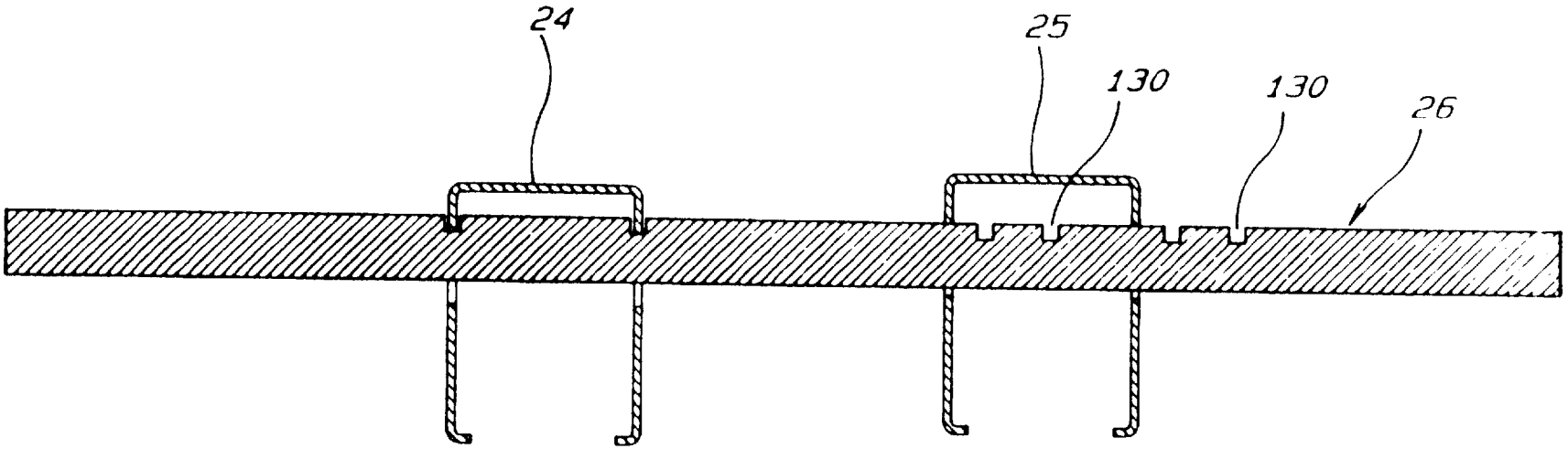
FIG. 10 is a longitudinal sectional view of a transverse support member provided with a plurality of track-locking notches.

It will be recognized that many variations may be made to the foregoing within the scope of the present invention. For example, notches or recesses 130 as shown in FIG. 10 may be formed in the upper surfaces of the transverse members 26 and 28 instead of using the sleeves 52. Such notches 130 receives the perimeters of the apertures 40 and 42 and lock the tracks such as at 24 and 25 in position.

Figure 11:
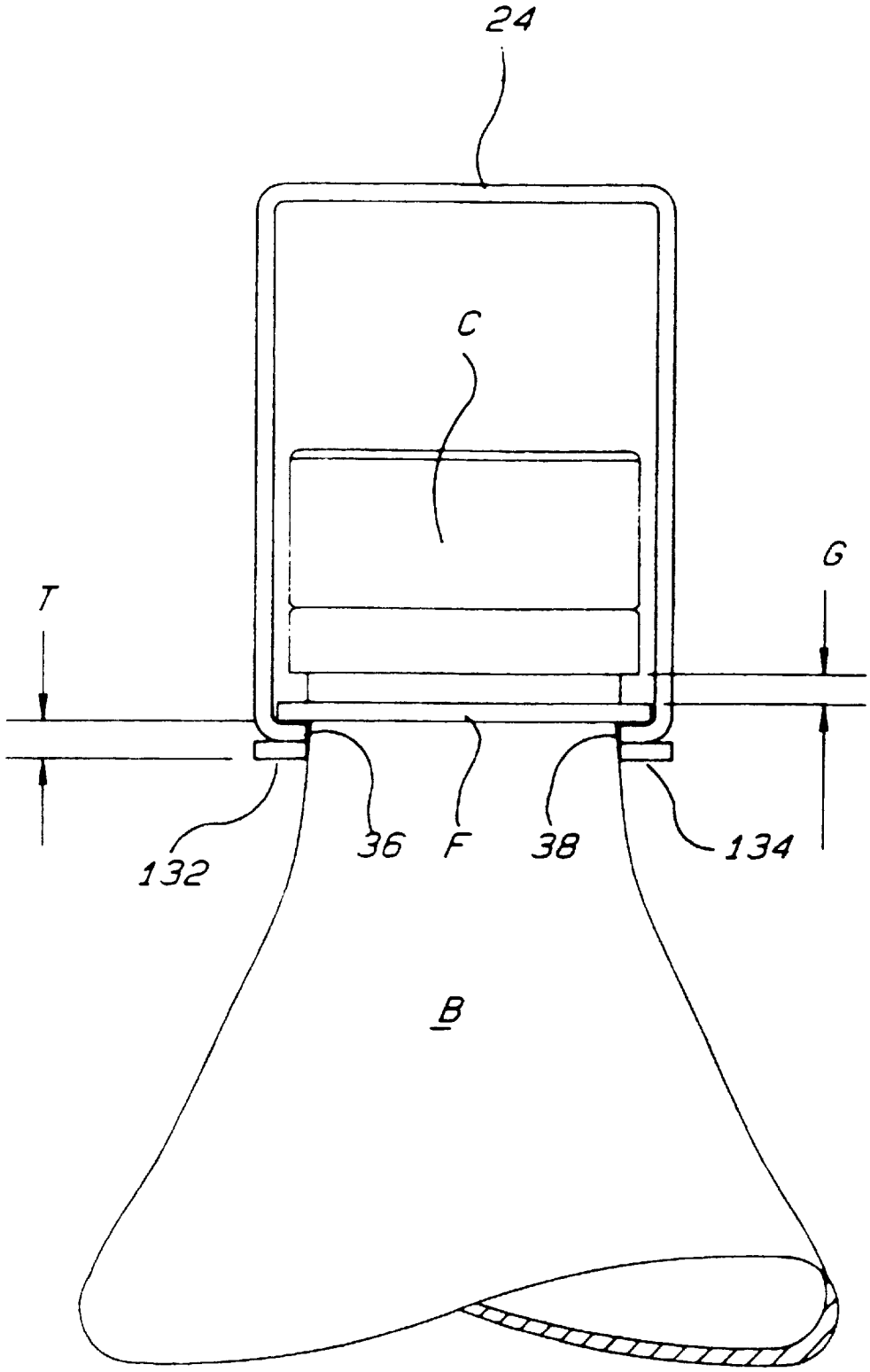
FIG. 11 is a front view of a track provided with a thickening rail piece at the front or rear end thereof.

It should be also recognized that rail-thickening means such as the portion 116 and 118 may be provided at the rear end of each track. The thickening means may be a separate rail piece formed of metal or plastic rather than a portion integrally formed with the respective track. Such a separate piece or pieces may be secured to either the upper or lower surface of each rail by suitable means such as welding, gluing, ultrasonic welding and the like. A typical example of such separate thickening means is shown in FIGS. 3 and 11 at 132 and 134 wherein the total thickness "T" of the thickening means 132 or 134 and the associated rail 36 or 38 is greater than the size "G" of the gap between the cap "C" and the flange "F" of any one of the bottles "B" that are displayed on the device.

It should be further recognized that the track rails may be coated or covered with low friction material entirely along the length thereof in order to minimize friction between the rails and each bottle supported thereon. Examples of such a low friction material include polystyrene having silicone or some other suitable lubricant agent dispersed therein, polytetrafluoroethylene, and the like. The rail cover formed of such material may be of a C-shaped cross section to receive therein the associated track rail. Otherwise, such a cover may be a lubrous tape.

It should be further recognized that the ceiling member 122 may be replaced with a separate guide piece secured to the inside surface of the track 88. Such a separate ceiling member is preferably formed of low friction material and more preferably of plastic having a lubricant agent dispersed therein. Although in FIG. 8, the front end of the ceiling member 122 is longitudinally spaced from the latch 98, the ceiling member 122 may be extended forward such that it overlaps the latch 98.

It should be further recognized that the slots 64 may be replaced with arcuate slots each disposed obliquely along the respective side wall and curved to have a downwardly convex configuration.

Figure 12:
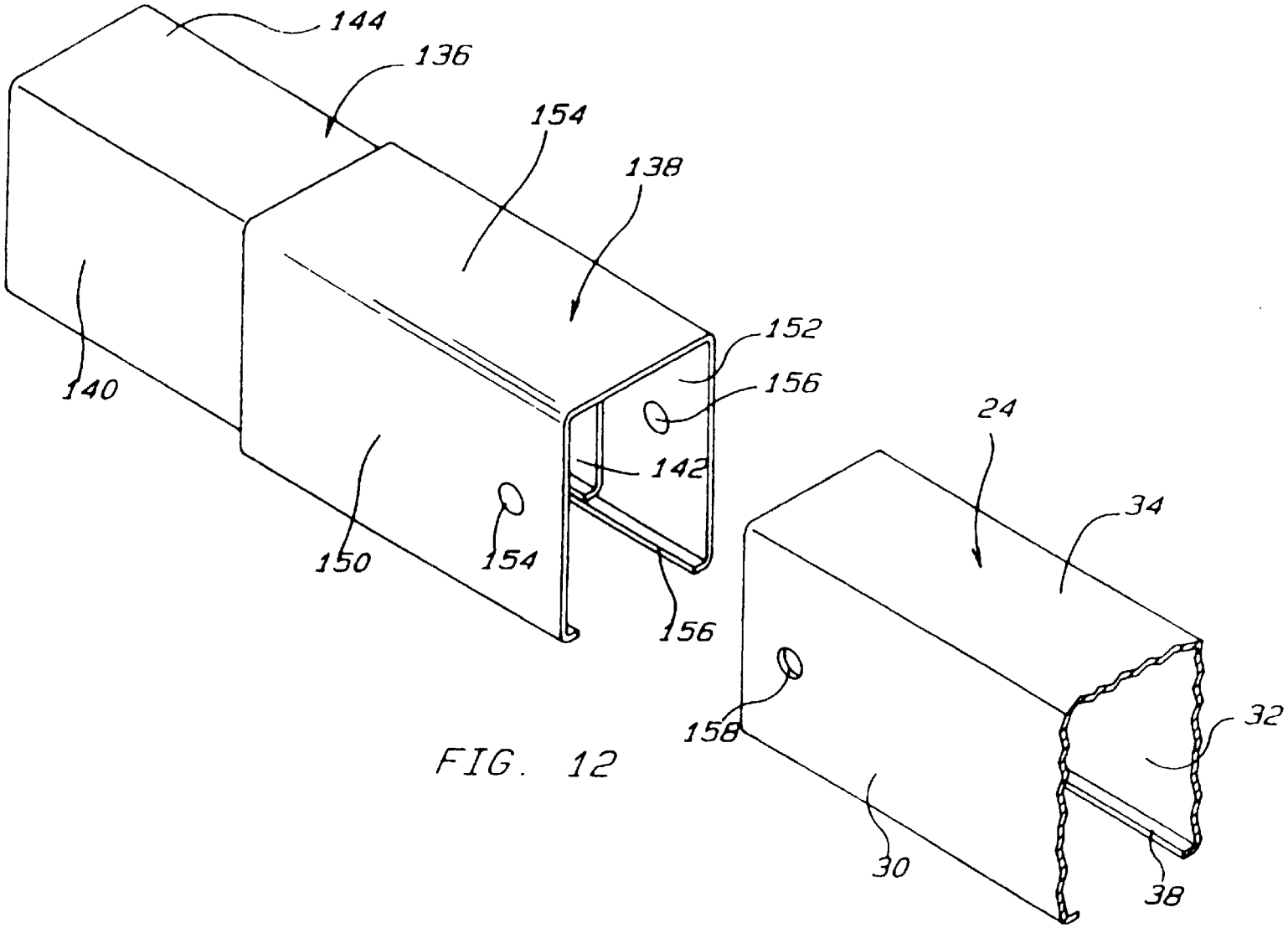
FIG. 12 is a perspective view of a track extension.
Figure 14:
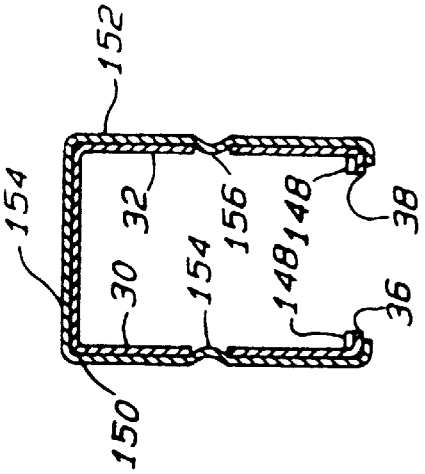
FIG. 14 is a view taken along the line XIV—XIV in FIG. 13
Figure 13:
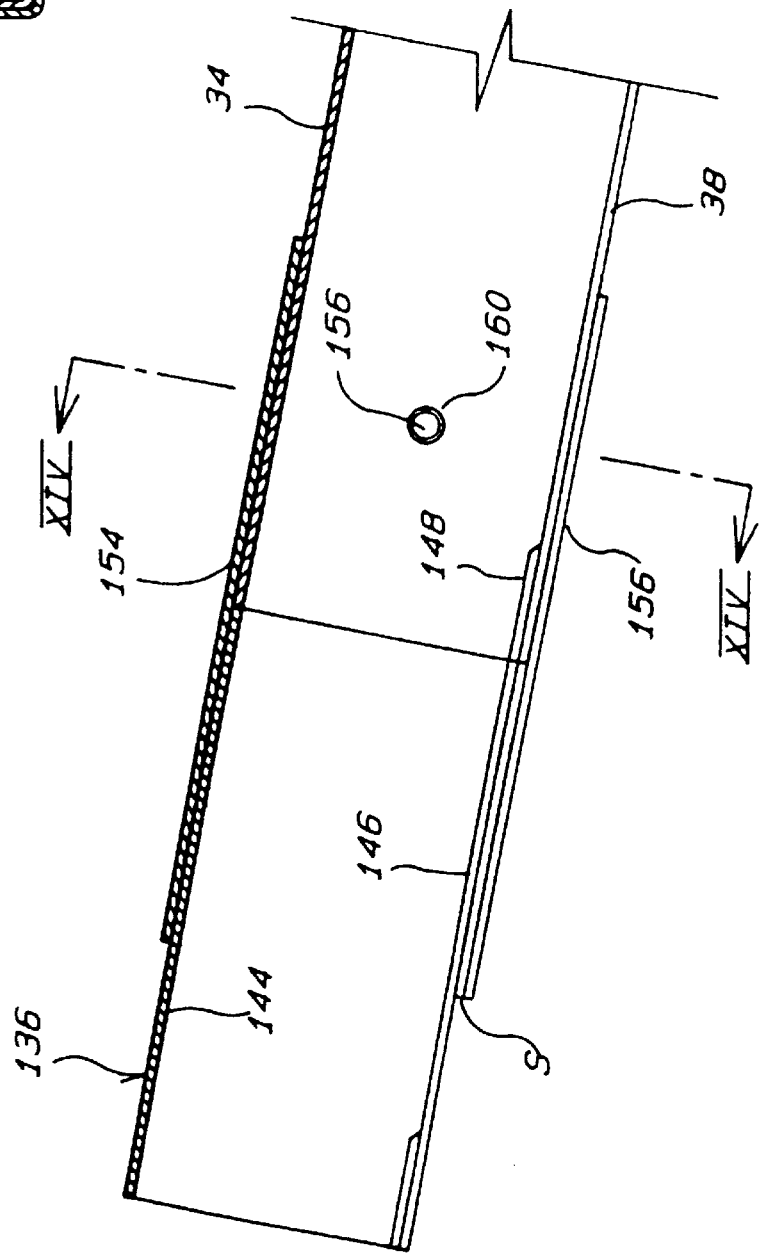
FIG. 13 is a longitudinal sectional view of the extension in FIG. 12 which has been connected to the rear end of a track.

It should be further recognized that each track may be provided with an extension connected to the rear end thereof. An example of such an extension is illustrated in FIGS. 12–14 wherein reference numerals 136 and 138 respectively denote a channel-shaped extension and a channel-shaped connector secured to the extension 136.

The extension 136 may be dimensioned such that the distance between its side walls 140 and 142 is equal to the distance between the track side walls such as at 30 and 32 and that the distance between the extension top wall 144 and the extension rail 146 is equal to the distance between the track top wall such as at 34 and a rear end thickening means 148. The means 148 is a rail piece secured to the upper surface of the track rail such as at 38. The connector 138 may be dimensioned such that it can telescopingly receive the rear end of the track such as at 24. The distance between the side walls 150 and 152 of the connector 138 may be slightly greater than the distance between the track side walls 30 and 32, and the distance between the connector top wall 154 and the connector bottom 156 is slightly greater than the distance between the track top wall 34 and the track rail 38.

The connector top wall 154 and the side walls 150 and 152 may be secured to the extension 136 such that the connector bottom 156 is disposed at a space "S" (shown in FIG. 13) from the extension rail 146. The inside surfaces of the connector side walls 150 and 152 may be provided with bumps 154 and 156 for releasable engagement with apertures 158 and 160 in the track side walls 30 and 32. Such bumps 154 and 156 may be formed by denting the outside surfaces of the track side walls 30 and 32.

What is claimed is:

1. A gravity feed merchandising device comprising a track support means, and at least one longitudinally extending track supported by said support means and having front and rear ends, each track having a tubular configuration, sidewalls and including a pair of parallel rails defining a space therebetween, which rails support a row of bottles each having a cap and an annular neck flange at a neck of said each bottle with the underside of said neck flange engaging said rails for movement relative to said rails, said support means retaining said each track inclined downwardly toward said front end of said each track so said bottles are gravity fed to said front end of said each track as a leading bottle in said row is removed successively from said each track, said each track includes a spring-urged stopper means at said front end of said each track for abutting said cap of said leading bottle, said stopper means including leaf springs extending inwardly from said sidewalls to engage said leading bottle to prevent said bottles from being removed from said each track, said stopper means defining a front opening of said each track having height and width dimensions whereby said cap of said leading bottle will be prevented from dislodgement through said front opening when said leading bottle is supported by said each track, but can be removed from said each track through said front opening when pulled against said stopper means.

2. The gravity feed merchandising device in accordance with claim 1 in which said said stopper means forms a portion of said side walls which engages said cap of said leading bottle to prevent said bottles from being removed from said each track.

3. A track device comprising a track having a tubular configuration, side walls and a pair of parallel rails defining a space therebetween, which rails support a row of bottles each having a cap and an annular neck flange at a neck of said each bottle with the underside of said neck flange engaging said rails for movement relative to said rails, and support means for retaining said track inclined downwardly toward a front end of said track so said bottles are gravity fed to said front end of said each track as a leading bottle in said row is removed successively from said track, said track includes a spring-urged stopper means at said front end of said track for abutting said cap of said leading bottle, said stopper means including leaf springs extending inwardly from said sidewalls to engage said leading bottle to prevent said bottles from being removed from said track, said stopper means defining a front opening of said track having height and width dimensions whereby said cap of said leading bottle will be prevented from dislodgement through said front opening when said leading bottle is supported by said track, but can be removed from said track through said front opening against the action of said stopper means.

4. The track device in accordance with claim 3 in which said said stopper means forms a portion of said side walls which engages said cap of said leading bottle to prevent said bottles from being removed from said track.

5. The track device in accordance with claim 3 in which each of said leaf springs includes an engaging element disposed at said front end for movement transversely of said track, said leaf springs urging said engaging elements transversely into said track, said engaging elements being positioned relative to said leading bottle such that when inside said track, said engaging elements abut said cap of said leading bottle to stop said leading bottle at said front end.

6. The track device in accordance with claim 5, in which said leaf springs are connected respectively to said side walls so that said engaging elements are movable transversely of said side wall.

7. The track device in accordance with claim 6, in which said each leaf spring has one and the other ends, said each leaf spring being secured at said one end to a respective one of said side walls to urge a respective one of said engaging elements.

8. The track device in accordance with claims 7, in which said respective engaging element is provided at said other end of said each leaf spring.

* * * * *